US011540381B1

(12) United States Patent
Benavides et al.

(10) Patent No.: US 11,540,381 B1
(45) Date of Patent: Dec. 27, 2022

(54) HIGH PROPELLANT THROUGHPUT HALL-EFFECT THRUSTERS

(71) Applicant: United States of America as represented by the Administrator of NASA, Washington, DC (US)

(72) Inventors: Gabriel F. Benavides, Cleveland, OH (US); Hani Kamhawi, Cleveland, OH (US); Timothy R. Verhey, Cleveland, OH (US)

( * ) Notice: Subject to any disclaimer, the term of this patent is extended or adjusted under 35 U.S.C. 154(b) by 12 days.

(21) Appl. No.: 16/932,023

(22) Filed: Jul. 17, 2020

Related U.S. Application Data

(60) Provisional application No. 62/876,209, filed on Jul. 19, 2019.

(51) Int. Cl.
*H05H 7/04* (2006.01)
*F03H 1/00* (2006.01)
*H01J 27/02* (2006.01)

(52) U.S. Cl.
CPC ..... *H05H 7/04* (2013.01); *F03H 1/0081* (2013.01); *H01J 27/022* (2013.01)

(58) Field of Classification Search
CPC ..... H05H 7/04; F03H 1/0081; H01J 27/022
See application file for complete search history.

(56) References Cited

U.S. PATENT DOCUMENTS

| | | | | |
|---|---|---|---|---|
| 7,500,350 | B1 * | 3/2009 | Jacobson | F03H 1/0075 60/202 |
| 10,002,738 | B1 * | 6/2018 | Farnell | C22C 1/045 |
| 2017/0284380 | A1 * | 10/2017 | Hofer | F03H 1/0068 |

* cited by examiner

*Primary Examiner* — Henry Luong
(74) *Attorney, Agent, or Firm* — Robert H. Earp, III; Mark Wolfgang; Helen M. Galus

(57) ABSTRACT

High propellant throughput Hall-effect thrusters (HETs) and components thereof are disclosed. A compact and high propellant throughput HET has an improved magnetic circuit that mostly shields the discharge chamber walls from high-energy ionized propellant, low-profile sacrificial pole covers to delay magnetic pole erosion, a unique discharge chamber subassembly, a mechanically crimped cathode emitter retainer to increase efficiency, a center-mounted hollow cathode, or a combination thereof. Such feature(s) may balance propellant throughput and thruster performance, minimize the volume of the thruster envelope, and/or simplify the thruster assembly.

17 Claims, 9 Drawing Sheets

HIGH PROPELLANT THROUGHPUT HALL-EFFECT THRUSTERS

CROSS-REFERENCE TO RELATED APPLICATION

This application claims the benefit of U.S. Provisional Patent Application No. 62/876,209 filed Jul. 19, 2019. The subject matter of this earlier filed application is hereby incorporated by reference in its entirety.

ORIGIN OF THE INVENTION

The invention described herein was made by employees of the United States Government and may be manufactured and used by or for the Government for Government purposes without the payment of any royalties thereon or therefore.

FIELD

The present invention generally relates to thrusters, and more particularly, to high propellant throughput Hall-effect thrusters and/or components thereof.

BACKGROUND

The Hall-effect thruster (HET) is the most successful in-space electric propulsion technology by quantity of units flown. The first HET flew in space in the early 1970s, and approximately another 1,000 HETs have flown since. As such, HETs are generally considered a mature technology. However, recent trends in HET application have sought to further lower cost, increase electrical efficiency, maximize propellant throughput capability, and optimize volume utilization. These improvements are especially sought after for the application of HETs to small spacecraft, where power, mass, volume, propellant-throughput, and cost are frequent spacecraft design drivers.

The rapid growth in demand for HETs can be attributed to their simple design, historically well-demonstrated reliability, good efficiency, high specific impulse, and high thrust-to-power ratio. Although the higher voltage gridded-ion thrusters (GIT) can achieve even higher specific impulse, HETs can achieve higher thrust-to-power ratios because the higher density quasi-neutral plasma of HETs is not subject to space-charge limitations. The higher thrust-to-power ratio of HETs will typically shorten spacecraft transit time. On the other end of the spectrum, arcjets provide significantly higher thrust than HETs. However, material limitations prevent arcjets from matching the electrical efficiency and specific impulse of HETs. For many missions, HETs provide a good balance of specific impulse, thrust, cost, and reliability.

As schematically shown in HET 100 of FIG. 1, HETs apply a strong axial electric field and radial magnetic field near the discharge chamber exit plane. An HET includes an anode and a cathode. The $\vec{E}\times\vec{B}$ force greatly slows the mean axial velocity of electrons and results in an azimuthal electron current many times greater than the beam current. This azimuthal current collisionally ionizes the incoming neutral propellant. These ions are then electrostatically accelerated and only weakly affected by the magnetic field. The electron source is a low work function material typically housed in a refractory metal structure (i.e., the hollow cathode), historically located external to the HET body.

However, recent thruster designs have begun centrally mounting the cathode in the HET body. The cathode feeds electrons to the HET plasma and neutralizes the plasma plume ejected from the thruster. The high-voltage annular anode sits at the rear of the discharge chamber and typically also functions as the propellant distribution manifold.

One implementation of an HET is shown as part of a complete propulsion system 200 in FIG. 2. Propulsion system 200 consists of: (i) an HET; (ii) a power processing unit (PPU); (iii) a propellant tank; (iv) a propellant management assembly (PMA); and (v) a propellant flow controller (PFC). The PPU accepts commands and low-voltage power (i.e., lower than the discharge voltage) from the spacecraft and converts the power to the necessary voltages and currents for thruster operation. Typically, the PPU includes: (i) a discharge power supply that provides high voltage to the thruster anode; (ii) a heater power supply that provides high current to the cathode heater to support cathode ignition; (iii) a cathode ignitor power supply that provides high voltage and low current pulsing to the cathode keeper to support cathode ignition; (iv) a cathode keeper power supply that provides a modest sustainer voltage and current to the cathode keeper following ignition; and (v) a magnet power supply that provides modest voltage and current to the thruster electromagnets to maintain the radial magnetic field.

The PPU may combine the heater, keeper, and magnet power supply functions into two or fewer power supplies. This reduces functionality, but may also reduce PPU complexity and cost. If a heater-less cathode is used, no cathode heater power supply is required. The system control board (SCB) accepts commands from the spacecraft, returns telemetry, and manages the various power supplies internal to the PPU. The PPU also powers and regulates the propellant flow controller to deliver the appropriate level of propellant to the thruster.

The propellant tank is typically a high-pressure vessel for storage of the propellant, although novel propellants such as iodine may have different storage requirements than heritage propellants such as xenon and recently krypton. The PMA typically manages the propellant pressure supplied to the PFC. Additionally, the PMA may include fill and drain valves, isolation valves, and sensors. The PMA is managed by the spacecraft, whereas the PFC is managed by the PPU.

The PFC may consist of one or more propellant flow control elements, such as proportional control valves, thermal throttles, solenoid valves, latch valves, filters, or restrictors. A simple PFC may include a proportional flow control valve followed by a flow split, including flow restrictors on each leg of the split that deliver a predetermined percentage of the total propellant flow to the anode and cathode. The PPU typically can adjust the total flow rate from no-flow to max-flow, while the fractional flow split between the anode and cathode remains unchanged based on the ratio of the flow properties of the restrictors. The power consumption of an HET is approximately proportional to the propellant flow rate. Thus, the PPU can affect the HET power consumption by regulating the propellant flow rate and monitoring the thruster current. More complex PFCs may include independent anode and cathode proportional flow control valves, pressure sensors, and temperature sensors, but largely accomplish the same functions with some added capability. For propulsion systems employing xenon propellant, the PFC may be commonly referred to as the xenon flow controller (XFC).

FIG. 3 illustrates an HET 300. The magnetic circuit includes a radial inner and a radial outer magnetic pole, a radial inner and outer screen, and a back pole that couples the poles and screens. Additionally, the magnetic circuit contains an inner and outer magnet winding, which magnetizes the soft magnetic alloy from which the poles, screens, and back pole are fabricated. The inner winding is applied directly to the inner magnetic core, while the outer winding is applied to a bobbin, which is separately installed in the thruster body. The magnetic circuit elements combine to establish a radial magnetic field across the discharge chamber that results in a specific shape for the magnetic field topology.

The inner and outer front poles are protected by sacrificial pole covers to prevent erosion of the magnetic circuit. The cathode subassembly largely consists of a low work function emitter, a spring, an emitter retainer, a tube, an orifice plate, and a heater. The cathode subassembly is center mounted in the HET in a largely straight bore in the inner magnetic core. Radially located between the cathode subassembly and the inner core wall is a cathode keeper tube that is terminated at the downstream end by an orifice plate. The keeper serves as a secondary electrode for discharge ignition and operation, as well as protects the cathode subassembly from erosion during thruster operation.

A key life-limiting process of classical (i.e., not magnetically shielded) HETs is erosion of the discharge chamber wall by the plasma. As illustrated in FIG. 3, the magnetic field streamlines of a classical HET 300 largely intersect the discharge chamber wall. High-energy ions follow these field lines and slowly erode the chamber wall over time. Once the chamber wall is sufficiently eroded, the plasma erodes the magnetic circuit components until thruster operation degrades and then fails. Classical moderate power HETs of about 1 to 5 kW have historically demonstrated discharge chamber failure in under 10,000 hours of operation. Furthermore, classical low power HETs of less than 1 kW have historically demonstrated discharge chamber failure in under 3,000 hours of operation.

A more recent advancement in HETs is magnetic shielding. As shown in HET 400 of FIGS. 4A and 4B, the principal magnetic field streamlines are shaped such that they do not intersect the discharge chamber wall. Thus, high energy ions are limited from eroding the discharge chamber walls, thus drastically minimizing or even eliminating chamber wall erosion. The magnetic field topology is such that the magnetic field streamlines graze the chamfers of the downstream end of the discharge chamber walls. In doing so, discharge chamber wall erosion is not observed and, erosion is thus not a life-limiting process in a magnetically-shielded HET. The magnetic field topology required for full magnetic shielding of an HET discharge chamber wall is largely achieved by adjusting the geometry of the magnetic front poles and screens. For example, the gap between the screens and poles can become quite small to achieve this desired topology.

However, a drawback is that this close gap can create challenges with tolerance stack-up in the design of an HET, driving up the manufacturing cost. The tight screen gap also shunts significant magnetic flux, thus requiring a considerable total magnetic flux in the magnetic core to establish the desired radial magnetic field strength in the discharge chamber. The higher magnetic flux requirement of magnetically-shielded HETs compared to classical HETs, along with an associated increase in winding amp-turns, has the consequence of requiring a greater mass of the soft magnetic alloy to avoid saturation and more winding mass to minimize self-heating associated with current flowing through the winding in operation.

A side-effect of magnetic shielding is increased erosion of the front poles. As such, erosion of features protecting the front poles becomes a key life limiting process. Classic HETs such as HET 300 with less significant front pole erosion have typically relied on relatively thin ceramic coatings. Given the increase in the rate of erosion of sacrificial front pole protective features with magnetically shielded HETs, such as HET 400, coatings must become considerably thicker. Thick coatings become problematic as they are more challenging to apply and more likely to fail from thermally induced stresses in the materials during thruster operation. As such, thick sacrificial pole covers may be mechanically fastened to the front poles as shown in FIGS. 3, 4A, and 4B. These sacrificial pole covers may be conductive or insulating in nature depending on spacecraft and mission requirements. While this new life-limiting erosion process is unfortunate, the overall lifetime capability of HETs such as HET 400 is nonetheless greatly improved compared to classical HETs such as HET 300. Magnetically-shielded HETs have experimentally shown that 25,000 hours or more of operational lifetime is achievable, even at the sub-kilowatt power scale.

The addition of pole cover fasteners to mechanically attach the sacrificial pole covers to the magnetic poles creates an important consideration for the design of magnetically-shielded HETs such as HET 400. The fastener heads themselves are preferentially protected from plasma-induced erosion. Since the sputtering rate of typical fastener materials is fast, compared to typical pole cover materials, unprotected fastener heads are potentially life limiting. One approach is to protect fastener heads by thickening the front pole cover or adding bosses in the downstream direction in which to imbed the fastener heads, as illustrated in FIG. 3. While such an approach is effective at protecting the fastener heads from erosion, thickening the pole cover in the downstream direction, whether uniformly or with a step, increases the total mass of sputtered pole cover material over time. This additional material may further contaminate thruster and spacecraft surfaces.

The discharge chamber is an annular region of the thruster where the propellant is ionized and accelerated, although the acceleration region may extend beyond the physical exit plane of the thruster. At the base of the discharge chamber is the anode, which typically also functionally doubles as the propellant manifold. The walls of the discharge chamber are typically a dielectric, although conductive channels have been demonstrated. The discharge chamber walls may also be a combination of conductive and dielectric materials.

The propellant is fed into the anode at one or more locations, circulates around the anode in an internal plenum, and exits from a multitude of openings in the anode. The desired outcome is to eject the propellant into the discharge chamber such that the propellant achieves both azimuthal and radial uniform density as it flows downstream into the ionization region. To properly evaluate the discharge chamber flow properties (azimuthal and radial flow uniformity), the thruster must be largely assembled. This is because HETs are typically highly integrated devices, as shown in FIG. 3. This is due to numerous challenging design considerations being simultaneously solved, including very high operating temperatures, high-voltage components, large mismatches in linear coefficients of thermal expansion between components, and requirements for good propellant and magnetic field uniformity.

A drawback of this high degree of integration is often a largely sequential thruster assembly, where subassemblies can rarely be tested in isolation without some degree of disassembly prior to integration into the larger thruster assembly. Any disassembly, such as removing the propellant manifold from a test rig for measuring flow uniformity, risks introduction of complicating factors such as contamination or improper reassembly. As such, testing may preferentially be accomplished sequentially to ensure that once a component is installed in the thruster assembly, its configuration is not again broken. Sequential assembly and test is not a very efficient or flexible method for fabrication and testing of an HET.

The cathode emitter located within the cathode subassembly supplies copious amounts of electrons when heated that supports plasma generation in the HET. The cathode heater pre-heats the emitter to a temperature where electron extraction from the emitter becomes efficient. Once the cathode is operational, the process of extracting electrons from the cathode results in self-heating that by design is sufficient to maintain proper cathode temperature and the cathode heater can be disabled. In order to function effectively, the emitter is typically pressed firmly against the cathode orifice plate to provide good electrical and thermal connection. The orifice plate is typically welded to the cathode tube. In some cases, the cathode tube and orifice may be fabricated from a single stock of material.

Many methods have been implemented conventionally to retain the cathode emitter, such as: (i) a high temperature spring that runs the full length of the cathode tube; (ii) a structural high-temperature element that reaches up the length of the cathode tube to press on the emitter with a spring at one end; (iii) pinching of the cathode tube around the emitter, although damage to the emitter may result; (iv) press fitting the emitter into the cathode tube, although damage may result; and (v) high temperature elements attached to emitter that are secured upstream at the cathode tube interface with the propellant feedline. Regardless of the method of installation, key design challenges include: (i) minimizing heat loss from the emitter to other thruster components, which reduces efficiency and stresses the cathode heater; (ii) avoiding contamination of the emitter, which hinders emitter performance and lifetime; and (iii) avoiding the generation of debris that may clog the orifice plate or otherwise hinder performance.

Accordingly, an improved HET that solves one or more of these problems may be beneficial.

SUMMARY

Certain embodiments of the present invention may provide solutions to the problems and needs in the art that have not yet been fully identified, appreciated, or solved by current HETs. For example, some embodiments of the present invention pertain to high propellant throughput HETs and/or components thereof. Some embodiments pertain to a compact and high propellant throughput HET having an improved magnetic circuit that mostly shields the discharge chamber walls from high-energy ionized propellant, low-profile sacrificial pole covers to delay magnetic pole erosion, a unique discharge chamber subassembly, a mechanically crimped cathode emitter retainer to increase efficiency, a center-mounted hollow cathode, or a combination thereof. Such feature(s) may balance propellant throughput capability and thruster performance, minimize the volume of the thruster envelope, and/or simplify the thruster assembly.

In an embodiment, an HET includes a discharge chamber comprising a wall, an inner front pole, and an outer front pole located radially outward from the inner front pole. The HET also includes an inner screen located at least partially below the inner front pole, an outer screen located at least partially below the outer front pole, and a back pole located below the inner front pole and the outer front pole. The HET further includes an inner magnet winding located radially inside the inner screen and an outer magnet winding located radially outside the outer screen. The inner front pole, the outer front pole, the inner screen, the outer screen, the back pole, the inner magnet winding, and the outer magnet winding collectively form a magnetic circuit configured to provide a magnetic field topology. The magnetic field topology is configured to provide a magnetic field that partially intersects with a downstream end of the wall of the discharge chamber of the HET such that some ions generated by the discharge chamber of the HET contact the downstream end of the wall of the discharge chamber.

In another embodiment, an HET includes an inner front pole and an outer front pole located radially outward from the inner front pole. The HET also includes an inner front pole cover that covers and protects the inner front pole and an outer front pole cover that covers and protects the outer front pole. 25% or less of the inner front pole cover, the outer front pole cover, or both, protrude out from an exit plane of a discharge chamber of the HET in a downstream direction with respect to an emission of ions from the HET.

In yet another embodiment, a cathode subassembly for an HET includes a cathode tube. The cathode subassembly also includes an emitter and an emitter retainer located within the cathode tube. The cathode tube is crimped or swaged around the emitter retainer at one or more locations along a length of the emitter retainer.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

Unless otherwise indicated, similar reference characters denote corresponding features consistently throughout the attached drawings.

DETAILED DESCRIPTION OF THE EMBODIMENTS

Some embodiments pertain to high propellant throughput HETs and/or components thereof. For instance, the high-propellant throughput HETs of some embodiments are capable of processing 2-10 times propellant or more than comparable power-class classical HETs. Some embodiments pertain to a compact and high propellant throughput HET having an improved magnetic circuit that mostly shields the discharge chamber walls from high-energy ionized propellant, low-profile sacrificial pole covers to delay magnetic pole erosion, a unique discharge chamber subassembly, a mechanically crimped cathode emitter retainer to increase efficiency, a center-mounted hollow cathode, or a combination thereof. Such feature(s) may balance propellant throughput and thruster performance, minimize the volume of the thruster envelope, and/or simplify the thruster assembly.

Figure 5A:
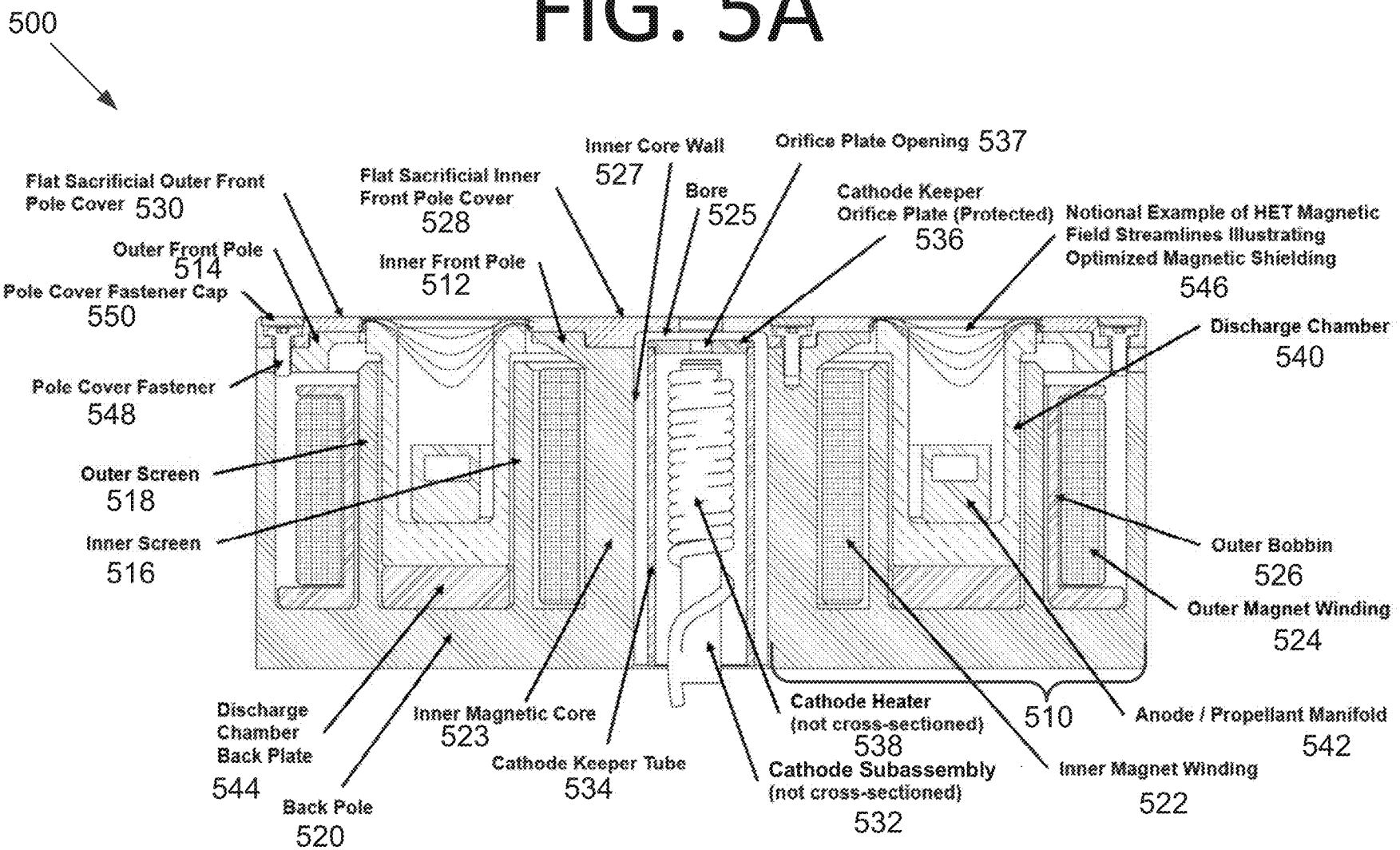
FIG. 5A is a side cutaway view illustrating an HET, according to an embodiment of the present invention.
Figure 5B:
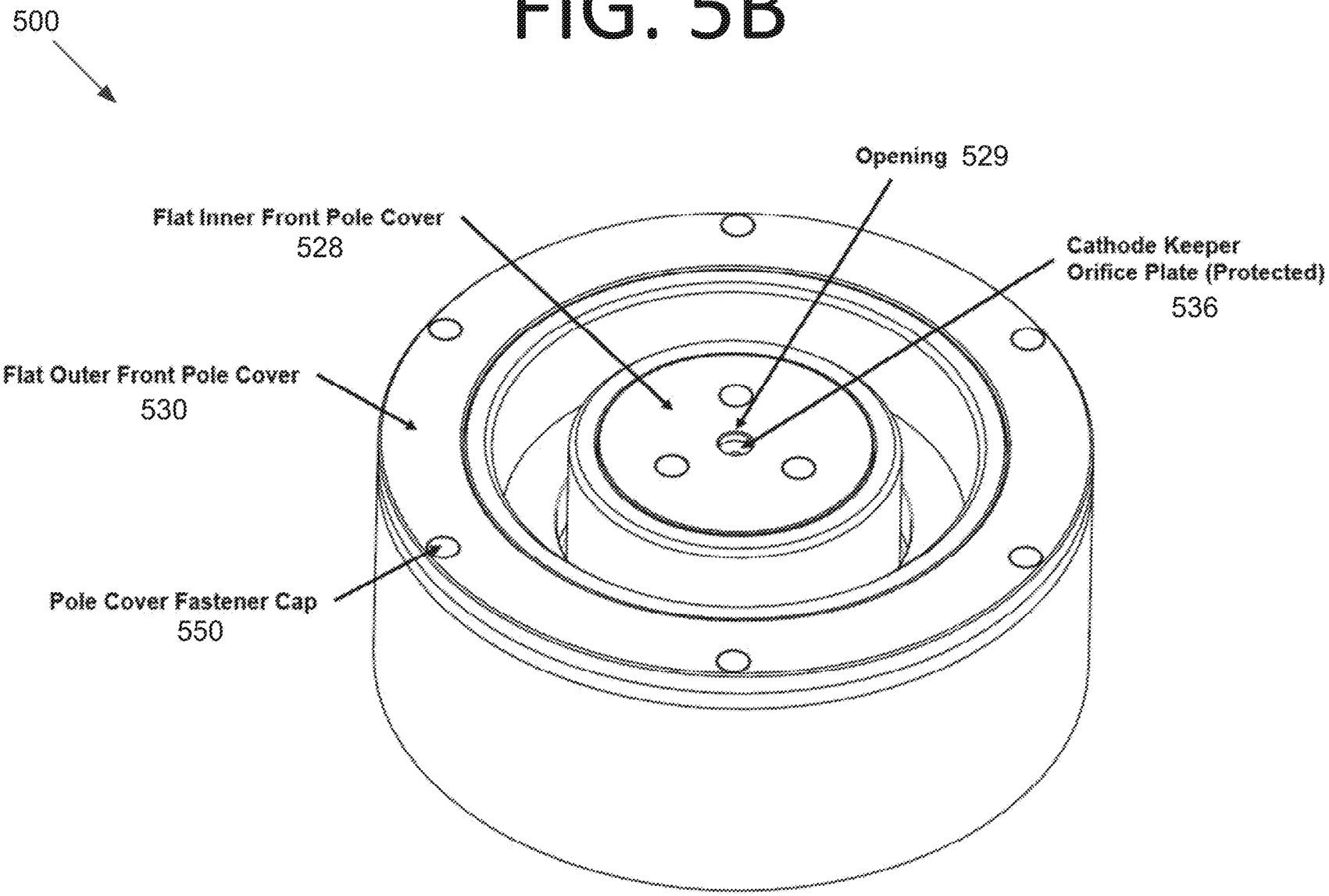
FIG. 5B is an isometric view illustrating the HET of FIG. 5A, according to an embodiment of the present invention.
Figure 5C:
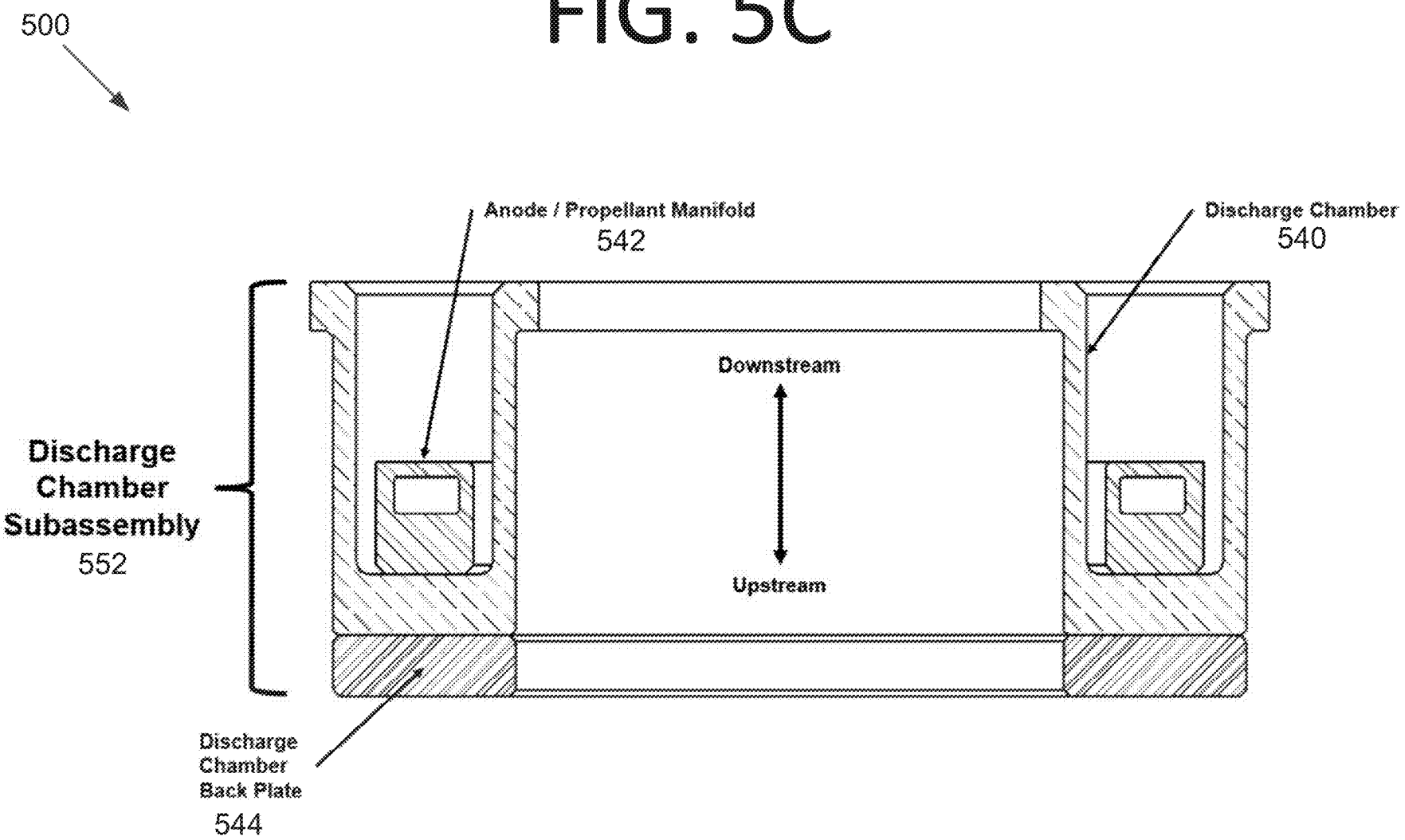
FIG. 5C is a side cutaway view illustrating a discharge chamber of the HET of FIG. 5A, according to an embodiment of the present invention.

FIGS. 5A-C illustrate an HET 500, according to an embodiment of the present invention. HET 500 includes a magnetic circuit 510 with various subcomponents. Magnetic circuit 510 includes a radial inner front pole 512 and a radial outer front pole 514, which establish a radial magnetic field across the downstream region of a discharge chamber 540. Magnetic circuit 510 also includes a radial inner screen 516 and a radial outer screen 518, which shape the magnetic field topology. Magnetic circuit 510 further includes a back pole 520 that couples inner front pole 512, outer front pole 514, inner screen 516, and outer screen 518, along with itself. Additionally, magnetic circuit 510 contains an inner magnet winding 522 and an outer magnet winding 524, which magnetize the soft-magnetic alloy from which inner front pole 512, outer front pole 514, inner screen 516, outer screen 518, and back pole 520 are fabricated. Inner magnet winding 522 is applied directly to an inner magnetic core 523, while outer magnet winding 524 is applied to an outer bobbin 526, which is separately installed in HET 500.

In FIG. 5A, inner magnetic core 523 may be a separate piece bolted to magnetic back pole 520 after inner magnet winding 522 is applied. Depending on the embodiment, one or more of the components of magnetic circuit 510 may be separate components and bolted to the rest without deviating from the scope of the invention. In large HETs, magnetic circuit 510 may be broken into six or more bolted components in some embodiments. Some smaller thrusters may have three or fewer bolted components to form magnetic circuit 510. This may provide the same effective design regardless of the number of components and bolted interfaces as a manufacturing and engineering choice. In certain embodiments, inner magnet winding 522 is not always applied directly to inner magnetic core 523. For instance, inner magnet winding 522 may be applied to an inner bobbin (not shown), which may be installed in a similar manner to outer bobbin 526. In certain embodiments, outer magnet winding 524 is not always applied to outer bobbin 526. For instance, outer magnet winding 524 may be applied directly to outer screen 518, eliminating the requirement for outer bobbin 526. In FIG. 5A, inner magnet winding 522 is applied directly to inner magnetic core 523 and outer magnet winding 524 is applied to outer bobbin 526.

Inner front pole 512 and outer front pole 514 are protected by sacrificial pole covers 528, 530, respectively, to delay erosion of magnetic circuit 510. Pole covers 528, 530 are attached with mechanical fasteners 548. However, fasteners 548 may be fabricated from materials that have a relatively fast rate of erosion when exposed to a plasma. To protect pole cover fasteners 548 from erosion, and thus themselves becoming the lifetime-limiting component of HET 500, pole cover fasteners 548 are covered with a pole cover fastener cap 550.

Figure 6:
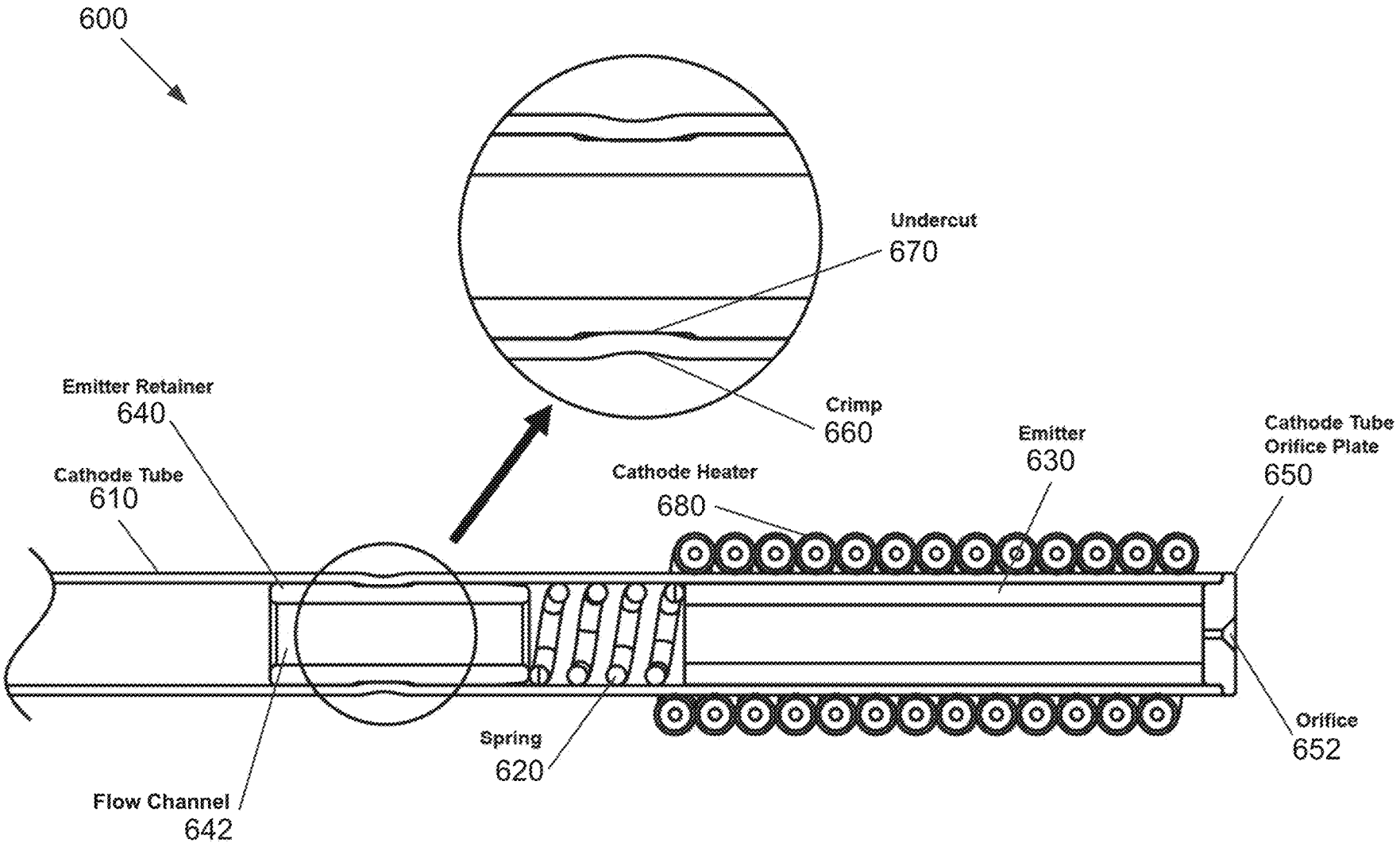
FIG. 6 is a side cutaway view illustrating a cathode subassembly, according to an embodiment of the present invention.

A cathode subassembly 532 generally includes a cathode tube (portions are visible above and below a heater 538; see also FIG. 6), a low work function emitter (not visible—contained within cathode subassembly 532), a spring (not visible—contained within cathode subassembly 532), an emitter retainer (not visible—contained within cathode subassembly 532), an orifice plate (located at the upper part of cathode subassembly 532; see also FIG. 6), and heater 538. In certain embodiments, cathode subassembly 532 may exclude heater 538. Such a configuration is typically referred to as a "heater-less cathode." In some embodiments, cathode subassembly 532 may be cathode subassembly 600 of FIG. 6. Heater 538 may reach high temperatures (e.g., up to 1,200° C. or more).

Cathode subassembly 532 is center mounted in HET 500 in a largely straight bore 525 in inner magnetic core 523. Radially located between cathode subassembly 532 and an inner core wall 527 is a cathode keeper tube 534 that is terminated at the downstream end by a cathode keeper orifice plate 536. The cathode keeper allows the cathode plasma to be active in the absence of an active discharge chamber plasma.

A discharge chamber 540 is surrounded by inner screen 516 and outer screen 518. Discharge chamber 540 also surrounds cathode subassembly 532. Discharge chamber 540 includes an anode/propellant manifold 542 that is mounted to back pole 520 via a discharge chamber back plate 544.

As can be seen, magnetic field streamlines 546 appear more similar to the magnetic field streamlines of fully magnetically-shielded HET 400. However, full magnetic shielding is not provided in HET 500. Rather, the magnetic field topology is configured to provide a magnetic field that partially intersects with a downstream end of the wall of the discharge chamber of the HET such that some ions generated in the discharge chamber of the HET contact the downstream end of the wall of the discharge chamber.

Improved Magnetic Shielding of an HET

As discussed above, full magnetic shielding of an HET discharge chamber in combination with low-sputter yield sacrificial pole covers, provides a theoretical capability for an HET operating life time of 25,000 hours or more. However, the anticipated HET lifetime requirement for most spacecraft missions, especially small spacecraft, is less than 15,000 hours. This is due to the inherently limited propellant storage capacity of the spacecraft if there is no ability to refuel. Also, refueling operations are anticipated to be expensive as the process is technologically difficult. As such, an HET with a 25,000 hour lifetime capability will rarely be needed or fully utilized in practice. As such, an HET can be further optimized as compared to fully magnetically shielded topologies to lessen the drawbacks associated with such topologies.

Full magnetic shielding, where the principal magnetic streamlines graze the downstream edge of the discharge chamber to avoid any erosion of the discharge chamber wall, has consequences. For instance, the sacrificial pole covers experience higher rates of erosion than classical HET magnetic streamline topologies, as notionally illustrated in HET 300 of FIG. 3. This necessitates an increased thickness of the pole covers and typically limits the pole cover materials to those with very low sputtering yields.

Improved HET magnetic circuit 510 of some embodiments provides various benefits. See FIGS. 5A-C. Magnetic circuit 510 provides an improved magnetic field topology, where inner front pole 512, outer front pole 514, inner screen 516, and outer screen 518 are designed and located such that a portion of principal magnetic field streamlines 546 are allowed to intersect the downstream end of the wall of discharge chamber 540. The gaps, heights, and relative diameters of the magnetic poles and materials will depend on the design. As a result, in this improved magnetic field topology, discharge channel erosion does weakly occur only at the downstream end, where a small chamfer is sometimes included. If the chamfer is not initially included, the chamfer may naturally form over time by the process of erosion.

However, since the ions bombarding the downstream end of discharge chamber 540 are not at anode potential, they result in a relatively slow rate of erosion, which may be at least an order of magnitude lower than classical HETs, such as HET 300, in some embodiments. Discharge chamber 540 may be constructed from boron nitride, for example. As such, while the rate of discharge chamber erosion at the downstream end is considerably greater than fully magnetically-shielded thrusters, such as HET 400, the rate of erosion is still slow enough to enable a lifetime operational capability on the order of 15,000 hours, which is consistent with the bulk of anticipated mission need.

By using the improved magnetic shielding topology of FIGS. 5A-C, for example, benefits are gained compared to full magnetic shielding. For instance, the rate of erosion of inner front pole cover 528 and outer front pole cover 530 is reduced compared to full shielding. Experiments have shown a decrease in front pole erosion by a factor of two or more. This may allow the use of a wider selection of front pole sacrificial materials to achieve the desired HET operational lifetime.

Low-Profile Sacrificial Pole Covers with Hidden Fasteners

As discussed above with respect to FIGS. 3 and 4, whether fully shielded or optimized shielding as described here, an unintended outcome of magnetic shielding is an increased rate of erosion of the inner and outer front pole sacrificial material compared to classical HETs. The sacrificial front pole protective surfaces are a lifetime-limiting feature of magnetically-shielded HETs. Where classical non-magnetically shielded thrusters typically use relatively thin sacrificial low-sputter yield ceramic coatings directly applied to the soft magnetic alloy front poles to delay erosion, magnetically-shielded or optimized-shielded thrusters necessitate a thicker low-sputter yield protective surface to enable a long thruster operational lifetime (i.e., high propellant throughput).

While thicker coatings may similarly self-adhere to the front poles to serve this purpose, they are more difficult to apply and are at greater risk of failure due to the mismatch of coefficients of thermal expansion between the thick coating and the underlying magnetic pole. These coatings are prone to flaking off. As such, a separate pole cover securely attached with mechanical fasteners is compelling. However, fasteners are commonly fabricated from materials that have a relatively fast rate of erosion when exposed to a plasma, such as steel alloys or titanium alloys.

To protect the fasteners from erosion, and thus becoming the lifetime limiting component themselves, the pole cover may be thickened in the downstream direction to recess the fastener and covered with a cap. This approach leaves the thickened pole cover with greater exposure to the discharge chamber plasma, which results in a higher rate of pole cover mass loss. While the erosion of some HET components appears unavoidable, minimizing the total mass of material sputtered is desirable given that the sputtered material may deposit on other thruster surfaces or critical spacecraft components, such as solar panels or payloads, which may cause operational issues for the thruster or spacecraft.

To solve the problems discussed above, some embodiments employ flat or low-profile front pole covers, such as flat sacrificial inner front pole cover 528 and flat sacrificial outer front pole cover 530 to reduce, minimize, or eliminate the contamination from sputtered material. Inner front pole cover 528 and outer front pole cover 530 do not protrude or slightly protrude beyond the downstream face of discharge chamber 540. The approach reduces the exposed surface area of inner front pole cover 528 and outer front pole cover 530 and locates the faces of pole covers 528, 530 as far upstream as practical in some embodiments to limit the rate and total mass of eroded cover material.

The low-profile may be achieved by a novel geometric shape (e.g., radially stepped inward) of magnetic inner front pole 512 and outer front pole 514 in some embodiments to allow sacrificial pole covers 528, 530 greater upstream thickness to provide the cover material to recess the heads of fasteners 548. Rather than the interface between front poles 512, 514 and their respective pole covers 528, 530 being flat, the interfaces in some embodiments are stepped in the upstream direction to create a volume in which to embed fasteners 548 in pole covers 528, 530, while maintaining a low-profile downstream pole cover surface. Previous designs maintain a flat or mostly flat interface where the pole cover protrudes in the downstream direction, resulting in a complex pole cover profile as seen by the discharge chamber plasma.

Note that while a flat downstream face may be considered ideal because it reduces design complexity, other surface profiles, such as roughened, rearward swept, rearward stepped, and/or wavy may be used without deviating from the scope of the invention. However, it should be noted that these should not protrude far downstream of the exit plane of discharge chamber 540 such that they fail to reduce, minimize, or eliminate the contamination from sputtered material (e.g., protruding 25% or less downstream of the exit plane of discharge chamber 540, which would be the horizontal line defined by the top of HET 500 of FIG. 5A). Rather than thickening the sacrificial pole covers in the downstream direction, as done conventionally, HET 500 has thickened pole covers 528, 530 in the upstream direction and the shape of the underlying magnetic material is adjusted to accommodate this thickening. For example, pole covers 528, 530 can be thickened radially in a stepwise fashion (e.g., a ring) or at discrete locations solely around the screw heads (e.g., bosses). This may be non-trivial since the magnetic flux may be restricted through the magnetic material. The design of the HET should accommodate for this.

For HET 500, the magnetic material of inner front pole 512 is radially stepped in the upstream direction in proximity to the bolt circle, either uniformly in the azimuthal direction or at discrete positions where each fastener 548 is located. Similarly, the magnetic material of outer front pole 514 is radially stepped in the upstream direction in proximity to the bolt circle, either uniformly in the azimuthal direction or at discrete positions where each fastener 548 is located. As used herein, the "bolt circle" refers to the imaginary circles formed by the common radial distance of the bolts securing inner front pole cover 528 and outer front pole cover 530, respectively. With reference to FIG. 5B, the bolt circle for inner front pole cover 528 would be an imaginary circle formed by the centers of the three pole fastener caps 550 thereof. Similarly, the bolt circle for outer front pole cover 530 would be an imaginary circle formed by the centers of the six pole fastener caps 550 thereof.

An undesirable outcome of removing material from the magnetic core is causing the magnetic flux to saturate by reducing the cross-section of the magnetic material. To prevent this saturation, the outer profile of magnetic inner front pole 512 is slanted, stepped, or otherwise shaped to maintain a sufficient cross-section of magnetic material. A similar design approach is implemented with magnetic outer front pole 514. After fasteners 548 are inserted in the recessed sacrificial material of thickened pole covers 528, 530 to secure them to respective poles 512, 514, they are covered with sacrificial fastener caps 550, typically of material similar to the material of sacrificial pole covers 528, 530 in some embodiments, to protect fasteners 548 from erosion. Caps 550 may be adhered, screwed, clipped, or pressed in place in some embodiments. While thickening pole covers 528, 530 in the downstream direction is known to increase the rate and total mass of sputtered material, thickening pole covers 528, 530 in the upstream direction has no known negative impact, thus providing an improved outcome.

In some embodiments, the pole cover material is alumina ceramic or graphite. However, various other materials may be used without deviating from the scope of the invention, including, but not limited to other ceramics, metals, and/or composites. The low-profile downstream face, limiting or eliminating pole cover material protruding downstream of the discharge chamber exit plane, advantageously limits the rate and total mass loss from pole covers 528, 530 onto other thruster and spacecraft surfaces.

Shielded Keeper Orifice Plate

Figure 1:
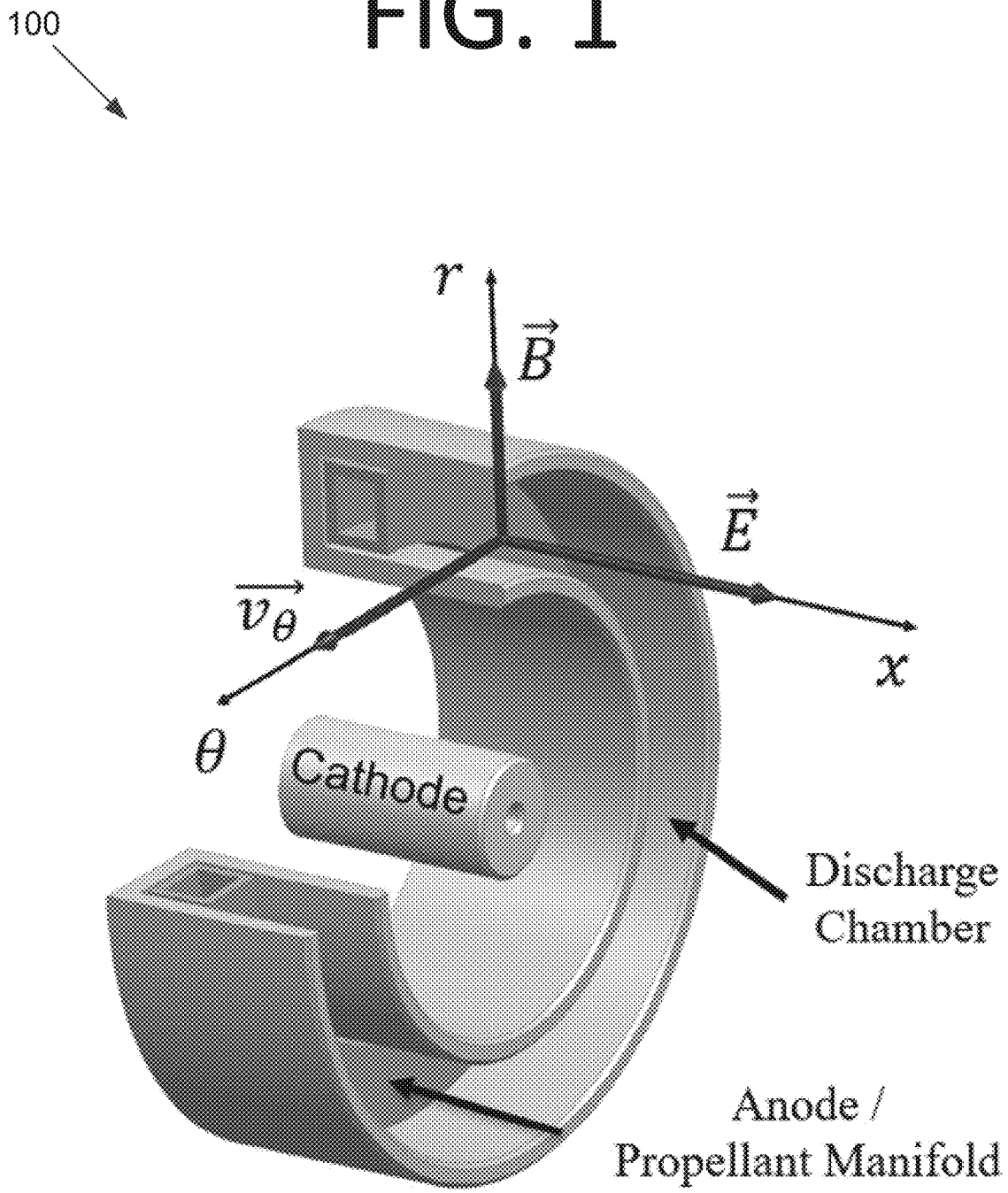
RELATED ART FIG. 1
FIG. 1 is a perspective cutaway view illustrating an HET.
Figure 2:
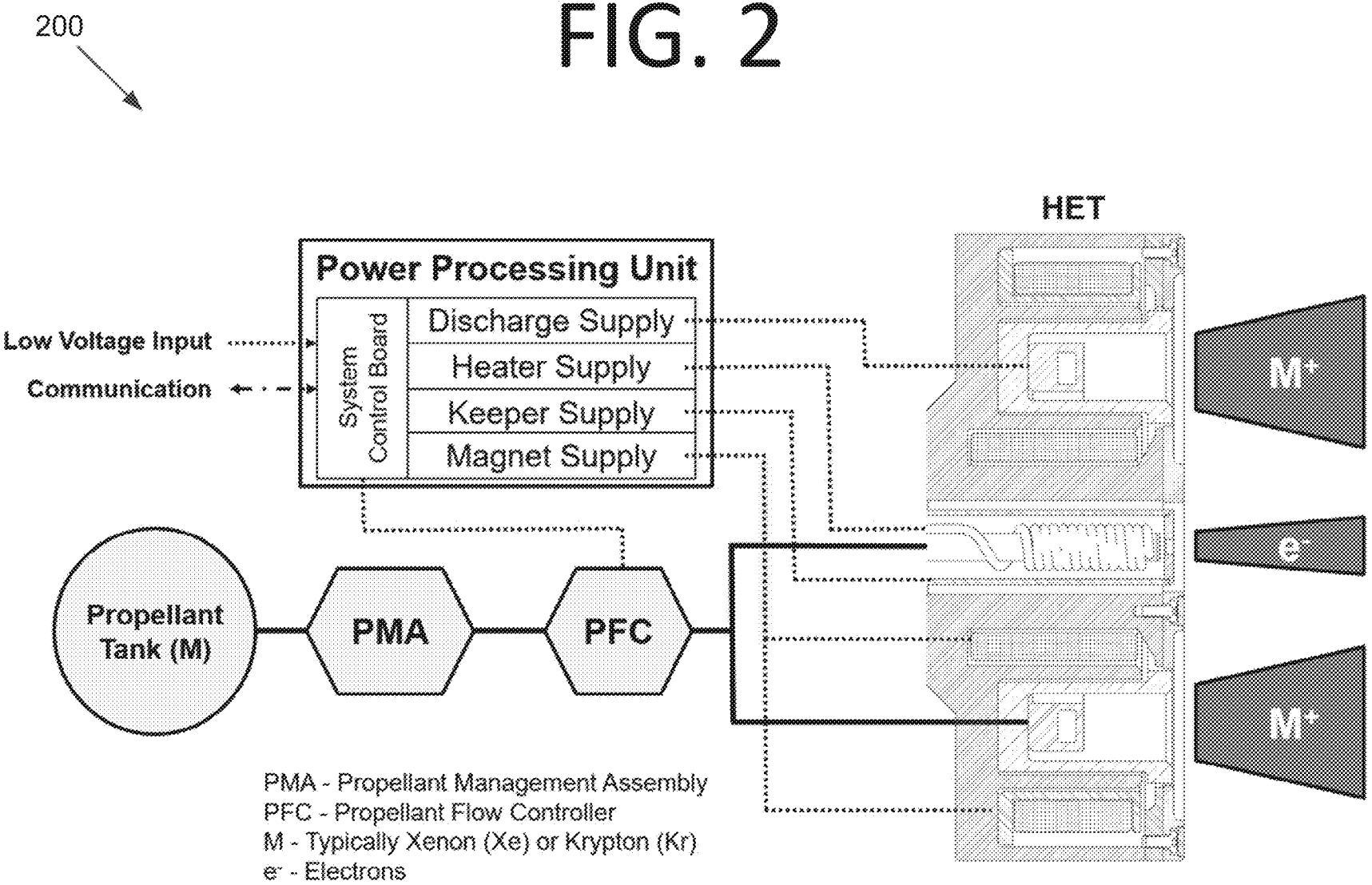
RELATED ART FIG. 2
FIG. 2 is an architectural diagram illustrating a Hall-effect propulsion system.
Figure 3:
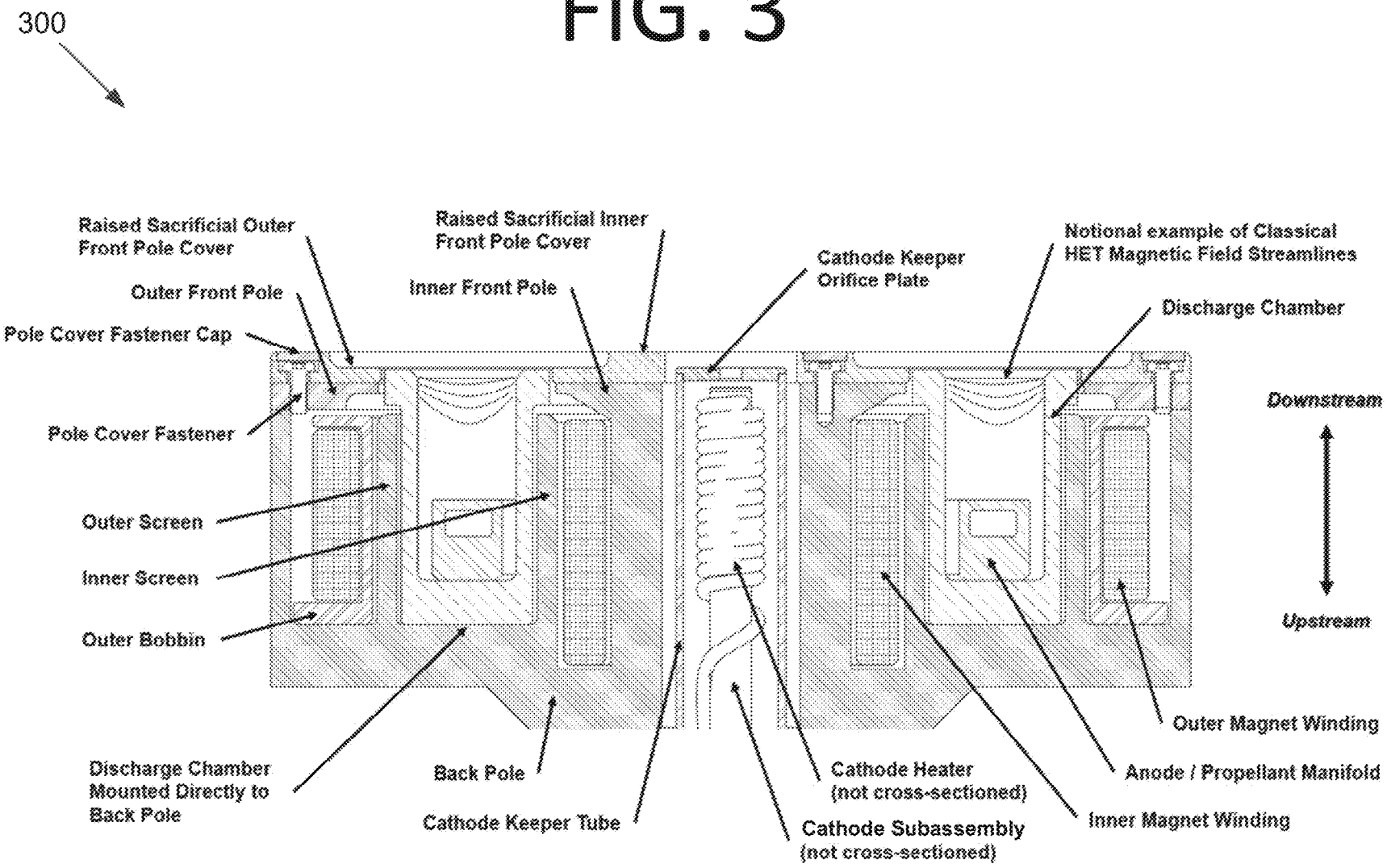
RELATED ART FIG. 3
FIG. 3 is a side cutaway view illustrating a classical HET design.
Figure 4A:
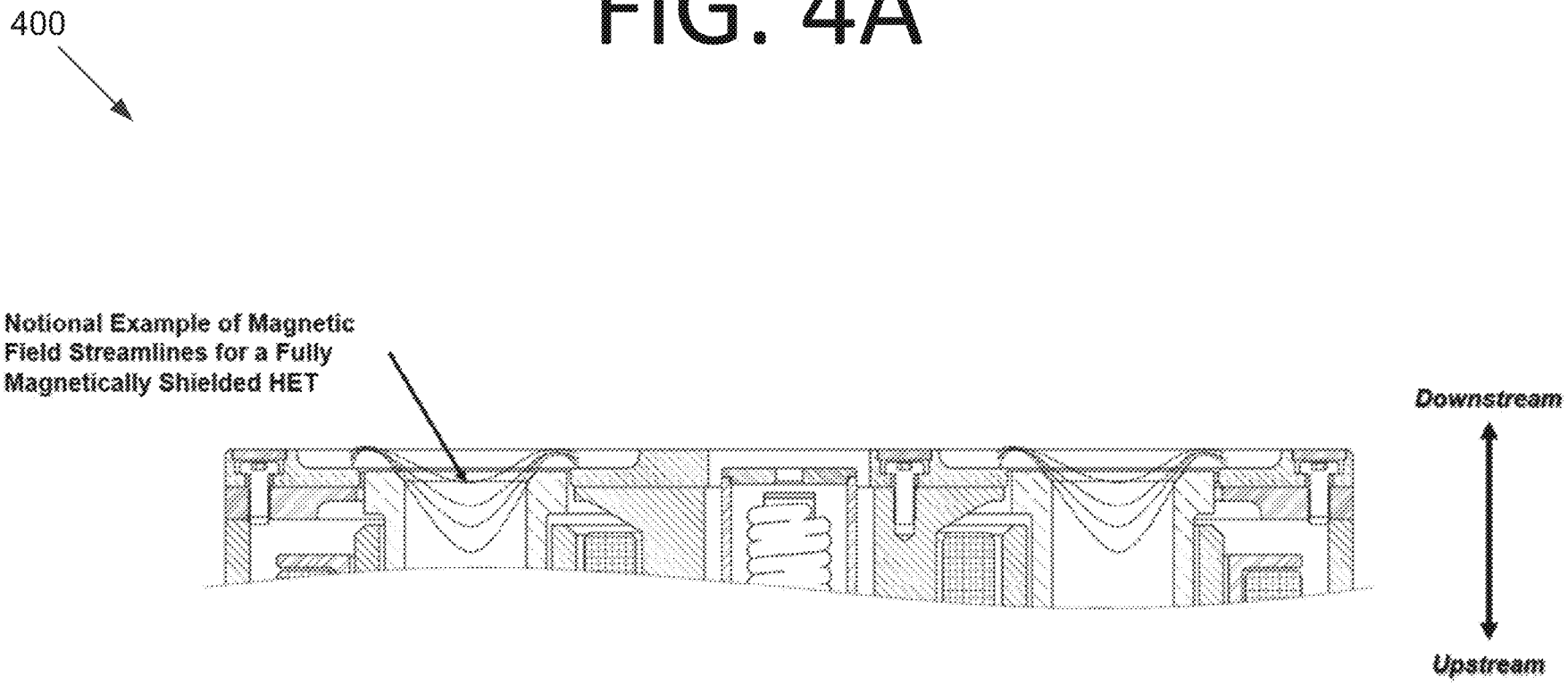
RELATED ART FIG. 4A
FIG. 4A is a side cutaway view illustrating a portion of a fully magnetically-shielded HET with magnetic field streamlines.
Figure 4B:
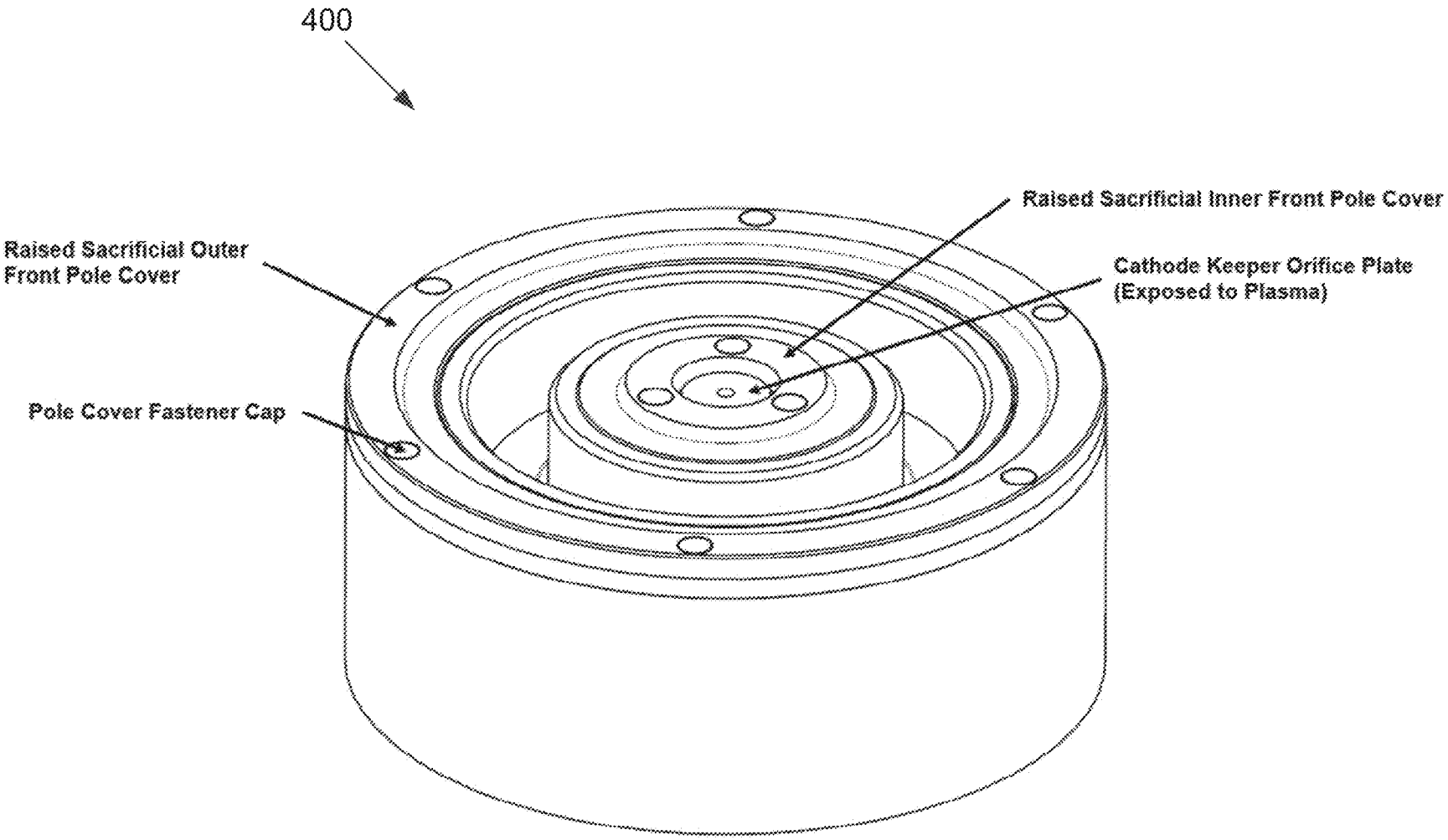
RELATED ART FIG. 4B
FIG. 4B is an isometric view illustrating the HET of FIG. 4.

Like the sacrificial front pole covers in FIGS. 3, 4A, and 4B, a keeper orifice plate exposed to the discharge chamber plasma of a magnetically-shielded HET with a center mounted cathode is subject to life-limiting erosion attributed to the high energy ions from the discharge chamber plasma. This keeper orifice plate erosion has been combated previously by fabricating the keeper orifice plate from low sputter yield materials and/or thickening the keeper orifice plate to achieve the desired component lifetime. This approach may result in the use of expensive materials and fabrication processes. Additionally, since the keeper orifice plate is necessarily fabricated from conductive materials, the sputtered keeper orifice plate material may pose a contamination risk if the sputtered material deposits on other thruster and spacecraft surfaces.

To solve these problems, HET 500 extends sacrificial inner pole cover 528 radially inward to provide a protective barrier for cathode keeper orifice plate 536. An opening 529 is maintained in sacrificial inner pole cover 528 to allow electrons from the cathode to exit downstream. Opening 529 is at least a size equal to an opening 537 in cathode keeper orifice plate 536, but smaller than the outside diameter of cathode keeper orifice plate 536 in this embodiment. This technique to protect cathode keeper orifice plate 536 may be applicable to magnetically-shielded, magnetically-optimized, and classical HETs with a center-mounted cathode.

By limiting erosion of cathode keeper orifice plate 536, a wider selection of materials to fabricate cathode keeper orifice plate 536 become conceivable. The ability to implement a wider variety of materials may simplify construction and reduce fabrication cost. The total mass of the sputtered material of cathode keeper orifice plate 536 is reduced, which reduces or minimizes contamination of other thruster and spacecraft surfaces. While cathode keeper orifice plate 536 is constructed of necessity from electrically conductive materials, sacrificial inner pole cover 528 may be fabricated from materials that pose little risk to the spacecraft, such as non-conductive ceramics. As such, erosion of sacrificial inner pole cover 528 is preferred to erosion of cathode keeper orifice plate 536 in some embodiments.

Discharge Chamber Subassembly

Previous HET designs require the thruster to be largely assembled to evaluate propellant manifold flow uniformity. This is because the propellant manifold is often an essential component to secure the discharge chamber into the thruster body. In some previous designs, the magnetic circuit forms an essential part of the discharge chamber wall. Thus, the propellant manifold cannot be properly evaluated outside the larger thruster assembly. While a jig that recreates the physical features of the assembled discharge chamber can be utilized to mount the propellant manifold for a dedicated component flow uniformity test, the configuration must be broken down to install the propellant manifold in the actual thruster body, which adds risk that the propellant manifold may perform differently in the thruster body than in the jig. Additionally, because the discharge chamber and propellant manifold are typically highly integrated with the final HET assembly, performing inspections of the propellant manifold and discharge chamber after integration for proper thermal, electrical, and mechanical interface can be challenging.

HET 500 solves these problems in a useful discharge chamber subassembly 552 (see FIG. 5C) by adding an annular discharge chamber back plate 544 to the upstream end of discharge chamber 540 and the propellant manifold stack-up. Anode/propellant manifold 542 mechanically fastens to annular discharge chamber back plate 544, sandwiching the rear of the wall of discharge chamber 540 rather than attaching directly to back pole 520. The propellant manifold fasteners (not shown) are electrically isolated from annular discharge chamber back plate 544 using dielectric washers (not shown) in some embodiments. This stack of components creates an assembly referred to herein as discharge chamber subassembly 552, which can be assembled independent of magnetic circuit 510 and independently evaluated for many factors including, but not limited to, fastener pre-load, flow uniformity, electrical isolation, and survival to flight environments. Without breaking the configuration of discharge chamber subassembly 552, subassembly 552 can then be installed in the thruster assembly and securely fastened with additional mechanical fasteners between back pole 520 and discharge chamber back plate 544 in some embodiments. Discharge chamber back plate 544 adds flexibility to the fabrication and test of HET 500 that may reduce risk, production time, and cost. Other Hall-effect thruster implementations require the thruster to be nearly fully assembled before such tests can be performed. This may provide cost and schedule savings in production.

Since discharge chamber 540 is not directly in contact with back pole 520, as is common in many other HET designs, but rather separated by back plate 544, the thermal interface between the back wall of discharge chamber 540 and back pole 520 can be tuned by selecting an appropriate material to construct back plate 544 or designing the geometry of back plate 544 to either encourage or discourage thermal energy transport (e.g., roughening). This can prove advantageous in managing the temperature of components, which is a universal concern with HET design.

Annular discharge chamber back plate 544 offers a convenient location to efficiently integrate features to electrically isolate the high voltage anode, which may be operating at hundreds of volts, from magnetic circuit 510. This can reduce the design complexity and assembly challenges that are often associated with implementing electrical isolation within the rear compartment of an HET.

Cathode Subassembly with Crimped Emitter Retainer

Many prior techniques for retaining an emitter create an additional thermal conduction path between the emitter and other structural elements in the thruster. This increases the power necessary to preheat and maintain the cathode emitter at operational temperatures. The increased wattage reduces thruster electrical efficiency and may reduce the lifetime of the cathode heater due to the increased stress resulting from a higher heater temperature requirement to attain the necessary emitter startup temperature. Some prior approaches for cathode subassembly fabrication and retaining of the emitter: (1) risk damage to the emitter or cathode tube during fabrication; (2) do not guarantee the emitter is fully seated or pressed against the orifice plate; (3) introduce an increased risk of cathode emitter contamination or the introduction of debris during fabrication (e.g., welds or press fit operations); and/or (4) require fabrication processes that increase production and inspection costs relative to the proposed solution, such as welds.

FIG. 6 is a side cutaway view illustrating a cathode subassembly 600, according to an embodiment of the present invention. Within cathode tube 610, a relatively short high temperature spring 620 is inserted behind an emitter 630, followed by an emitter retainer 640 that preloads spring 620. Preloaded spring 620 ensures that emitter 630 is fully seated and pressed against a cathode tube orifice plate 650, even if emitter retainer 640 is located with some uncertainty. Cathode tube 610 in this embodiment is then crimped or swaged around emitter retainer 640, which is fabricated from a more robust material than emitter 630 or cathode tube 610, allowing emitter retainer 640 to accept the compression of cathode tube 610, resulting from the crimping or swaging operation without component failure. An enlarged view of a crimp 660 and an undercut 670 is shown in the circle above cathode tube subassembly 600. Emitter retainer 640 may be crimped or swaged along the full circumference of cathode tube 610 at one axial location or crimpled more selectively around the circumference or multiple locations along the length of emitter retainer 640.

In some embodiments, emitter retainer 640 is pressed directly against emitter 630 without spring 620. During installation, an assembly fixture (not shown) may be used to ensure a good seating of emitter 630 and emitter retainer 640. The assembly fixture is removed following crimping or swaging of emitter retainer 640.

In certain embodiments, emitter retainer 640 may be a relatively short tubular section, as shown in FIG. 6. Alternatively, emitter retainer 640 may have a more complex flow path. In some embodiments, emitter retainer 640 may be fabricated from or contain a porous material. In some porous embodiments, a flow channel 642 is not included within emitter retainer 640. In certain embodiments, emitter retainer 640 may be fabricated from any suitable material with appropriate thermal properties to survive the operational environment, which may include, but is not limited to, refractory metals or ceramics. In some embodiments, emitter retainer 640 may include an undercut, roughening, or other surface or geometric modification to ensure that retainer 630 is well secured once crimped or swaged.

The approach described above may provide a straightforward and low-cost solution to retain a cathode emitter in the cathode subassembly, poses little risk of damage to the emitter during assembly, and requires no costly fabrication processes, such as welding. Because the retention mechanism is installed local to the emitter, no features extend significantly far upstream of the emitter, which reduces heat loss compared to prior techniques. This approach increases efficiency and reduces stress on a cathode heater 680 during startup.

If emitter retainer 640 is fabricated from a porous material excluding flow channel 642 so propellant is forced through the porous material, or a porous material is otherwise included in the construction of emitter retainer 640, emitter retainer 640 can perform a secondary function as a propellant filter to protect emitter 630 and an orifice 652 of cathode tube orifice plate from debris that may exist in the supplied propellant. Depending on the material used during construction, the material of emitter retainer 640 may also act as a getter material for chemical contaminates in the propellant that may otherwise damage emitter 630.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A Hall-effect thruster (HET), comprising:

a discharge chamber comprising a wall;

an inner front pole;

an outer front pole located radially outward from the inner front pole;

an inner screen located at least partially below the inner front pole;

an outer screen located at least partially below the outer front pole; and a back pole located below the inner front pole and the outer front pole;

an inner front pole cover comprising an orifice; and a cathode keeper orifice plate comprising an orifice, wherein the orifice of the inner front pole cover is at least a size equal to the orifice of the cathode keeper orifice plate, but smaller than an outside diameter of the cathode keeper orifice plate;

an inner magnet winding located radially inside the inner screen; and an outer magnet winding located radially outside the outer screen, wherein the inner front pole, the outer front pole, the inner screen, the outer screen, the back pole, the inner magnet winding, and the outer magnet winding collectively form a magnetic circuit configured to provide a magnetic field topology, and the magnetic field topology is configured to provide a magnetic field that partially intersects with a downstream end of the wall of the discharge chamber of the HET such that some ions generated in the discharge chamber of the HET contact the downstream end of the wall of the discharge chamber.

2. The HET of claim 1, wherein the discharge channel comprises a chamfer at the downstream end of the wall of the discharge chamber, and erosion of the discharge chamber from the ions occurs at the chamfer.

3. The HET of claim 2, wherein the chamfer does not exist in the discharge chamber initially and forms during operation of the HET.

4. The HET of claim 1, further comprising:

an anode, wherein the ions contacting the downstream end of the wall of the discharge chamber are not at a potential of the anode of the HET.

5. The HET of claim 1, wherein an interface between the inner front pole and the inner front pole cover, an interface between the outer front pole and the outer front pole cover, or both, are stepped in an upstream direction.

6. The HET of claim 1, further comprising:

a discharge chamber subassembly comprising an annular discharge chamber back plate located between the discharge chamber and the back pole, wherein the discharge chamber further comprises an anode/propellant manifold, the anode/propellant manifold is affixed to and electrically isolated from the annular discharge chamber back plate, and the discharge chamber is affixed to the back pole via the annular discharge chamber back plate.

7. The HET of claim 1, further comprising:

a cathode subassembly, comprising:

a cathode tube, and an emitter and an emitter retainer located within the cathode tube, wherein the cathode tube is crimped or swaged around the emitter retainer at one or more locations along a length of the emitter retainer.

8. The HET of claim 7, wherein the emitter retainer comprises a porous material configured to function as a propellant filter, a getter material for chemical contaminants in the propellant, or both.

9. A Hall-effect thruster (HET), comprising:

an inner front pole;

an outer front pole located radially outward from the inner front pole;

an inner front pole cover that covers and protects the inner front pole; and an outer front pole cover that covers and protects the outer front pole, wherein an end of the inner front pole cover, an end of the outer front pole cover, or both, are substantially coplanar with an exit plane of a discharge chamber of the HET in a downstream direction with respect to an emission of ions from the HET; and the inner front pole cover comprises a thickened section that extends radially inward into a corresponding recess in the inner front pole, the outer front pole cover comprises a thickened section that extends radially inward into a corresponding recess in the outer front pole, or both.

10. The HET of claim 9, wherein a downstream face of the inner front pole cover, the outer front pole cover, or both, is flat.

11. The HET of claim 9, further comprising:

a cathode keeper orifice plate comprising an orifice, wherein the inner front pole cover comprises an orifice, and the orifice of the inner front pole cover is at least a size equal to the orifice of the cathode keeper orifice plate, but smaller than an outside diameter of the cathode keeper orifice plate.

12. A cathode subassembly, comprising:

a cathode tube; and an emitter and an emitter retainer located within the cathode tube;

a spring located between the emitter and the emitter retainer within the cathode tube; and a cathode tube orifice plate;

wherein:

the cathode tube is crimped or swaged around the emitter retainer at one or more locations along a length of the emitter retainer and the spring presses the emitter against the cathode tube orifice plate.

13. The cathode subassembly of claim 12, wherein the emitter retainer comprises a porous material configured to function as a propellant filter, a getter material for chemical contaminants in the propellant, or both.

14. A Hall-effect thruster (HET), comprising:

a cathode subassembly, comprising:

a cathode tube, and an emitter and an emitter retainer located within the cathode tube, a spring located between the emitter and the emitter retainer within the cathode tube; and a cathode tube orifice plate; wherein the cathode tube is crimped or swaged around the emitter retainer at one or more locations along a length of the emitter retainer, and the spring presses the emitter against the cathode tube orifice plate a discharge chamber comprising a wall;

an inner front pole;

an outer front pole located radially outward from the inner front pole;

an inner screen located at least partially below the inner front pole;

an outer screen located at least partially below the outer front pole; and a back pole located below the inner front pole and the outer front pole;

an inner magnet winding located radially inside the inner screen; and an outer magnet winding located radially outside the outer screen, wherein the inner front pole, the outer front pole, the inner screen, the outer screen, the back pole, the inner magnet winding, and the outer magnet winding collectively form a magnetic circuit configured to provide a magnetic field topology, and the magnetic field topology is configured to provide a magnetic field that partially intersects with a downstream end of the wall of the discharge chamber of the HET such that some ions generated in the discharge chamber of the HET contact the downstream end of the wall of the discharge chamber.

15. A Hall-effect thruster (HET), comprising:

an inner front pole;

an outer front pole located radially outward from the inner front pole;

an inner front pole cover that covers and protects the inner front pole; and an outer front pole cover that covers and protects the outer front pole, wherein an end of the inner front pole cover, an end of the outer front pole cover, or both, are substantially coplanar with an exit plane of a discharge chamber of the HET in a downstream direction with respect to an emission of ions from the HET; and a cathode keeper orifice plate comprising an orifice, wherein the inner front pole cover comprises an orifice, and the orifice of the inner front pole cover is at least a size equal to the orifice of the cathode keeper orifice plate, but smaller than an outside diameter of the cathode keeper orifice plate.

16. The HET of claim 15, wherein a downstream face of the inner front pole cover, the outer front pole cover, or both, is flat.

17. The HET of claim 15, wherein the inner front pole cover comprises a thickened section that extends radially inward into a corresponding recess in the inner front pole, the outer front pole cover comprises a thickened section that extends radially inward into a corresponding recess in the outer front pole, or both.

* * * * *